United States Patent [19]

Kindig et al.

[11] 4,239,529

[45] Dec. 16, 1980

[54] PROCESS FOR BENEFICIATING SULFIDE ORES

[75] Inventors: James K. Kindig, Arvada; Ronald L. Turner, Golden, both of Colo.

[73] Assignee: Hazen Research, Inc., Gorden, Colo.

[21] Appl. No.: 86,830

[22] Filed: Oct. 22, 1979

Related U.S. Application Data

[63] Continuation-in-part of Ser. No. 921,584, Jul. 3, 1978, abandoned, which is a continuation-in-part of Ser. No. 868,416, Jan. 10, 1978, abandoned, which is a continuation-in-part of Ser. No. 658,258, Feb. 17, 1976, abandoned.

[51] Int. Cl.[3] ..... C22B 1/00

[52] U.S. Cl. ..... 75/1 R; 75/21; 209/8; 209/9; 209/214; 427/252

[58] Field of Search ..... 75/1 R, 1 T, 21, 28, 75/67, 72, 77, 82, 83, 111, 112; 423/23, 138, 25; 209/8, 9, 11, 214–214; 427/47, 252–255

[56] References Cited

U.S. PATENT DOCUMENTS

| | | | |
|---|---|---|---|
| 933,717 | 9/1909 | Lockwood | 209/8 |
| 970,002 | 9/1910 | Wentworth | 209/9 |
| 2,132,404 | 10/1938 | Dean et al. | 423/25 |
| 2,332,309 | 10/1943 | Drummond | 427/252 |
| 2,612,440 | 9/1952 | Altmann | 75/82 |
| 2,944,883 | 7/1960 | Queneau et al. | 75/82 |
| 3,252,791 | 5/1966 | Frysinger et al. | 75/82 |
| 3,323,903 | 6/1967 | O'Neil et al. | 75/82 |
| 3,490,899 | 1/1970 | Krivisky et al. | 423/25 |
| 3,669,644 | 6/1972 | Sato | 423/25 |
| 3,926,789 | 12/1975 | Shubert | 209/8 |
| 3,938,966 | 2/1976 | Kindig et al. | 44/1 R |
| 4,098,584 | 7/1978 | Kindig et al. | 44/1 R |

FOREIGN PATENT DOCUMENTS

| | | | |
|---|---|---|---|
| 179095 | 7/1954 | Austria | 75/112 |

*Primary Examiner*—L. Dewayne Rutledge
*Assistant Examiner*—Michael L. Lewis
*Attorney, Agent, or Firm*—Sheridan, Ross, Fields & McIntosh

[57] ABSTRACT

One or more mineral values of sulfide ores are beneficiated by treating the sulfide ore with a metal containing compound under conditions such as to selectively enhance the magnetic susceptibility of the mineral values to the exclusion of the gangue in order to permit a physical seaparation between the values and gangue.

52 Claims, No Drawings

PROCESS FOR BENEFICIATING SULFIDE ORES

CROSS REFERENCES TO RELATED APPLICATIONS

This application is a continuation-in-part of application Ser. No. 921,584 filed July 3, 1978, now abandoned which is a continuation-in-part of abandoned application Ser. No. 868,416 filed Jan. 10, 1978 abandoned, which is a continuation-in-part of now abandoned application Ser. No. 658,258 filed Feb. 17, 1976.

TECHNICAL FIELD

This invention relates to a means for treating ores to separate the mineral value(s) from gangue material by selectively enhancing the magnetic susceptibility of the mineral value(s) so that they may be magnetically removed from the gangue.

BACKGROUND ART

As is well known, mining operations in the past for recovering various metals, e.g., lead, copper, have utilized high grade ore deposits where possible. Many of these deposits have been exhausted and mining of lower grade ores is increasing. The processing of these leaner ores consumes large amounts of time, labor, reagents, power and water with conventional processing.

In addition to the increased expense associated with the extraction of these metals from low grade ores, proposed processes for separation of certain of the sulfide ores are technically very difficult and involve elaborate and expensive equipment. In many cases the expense incurred by such separation would be greater than the commercial value of the metal, such that the mineral recovery, while theoretically possible, is economically unfeasible.

Accordingly, it is a principal object of this invention to provide a method of treating ores which separates the mineral values from gangue material by selectively enhancing the magnetic susceptibility of one or more mineral values in order that they may be magnetically removed from the gangue.

DISCLOSURE OF THE INVENTION

The process of the present invention entails treating a metal sulfide ore mixture with a metal containing compound under processing conditions such that the magnetic susceptibility of the ore is selectively enhanced by the exclusion of the gangue. The affected ore values may then be magnetically separated from the less magnetic constituents.

BEST MODE FOR CARRYING OUT THE INVENTION

The process of the present invention is particularly useful for concentrating sulfide minerals. The process employs the treatment of the sulfide ore with a metal containing compound in order to selectively enhance the magnetic susceptibility of various mineral values contained within the ore. The treated mixture can then be treated by magnetic means to produce a beneficiated product.

"Enhancing the magnetic susceptibility" of the ore as used herein is intended to be defined in accordance with the following discussion. Every compound of any type has a specifically defined magnetic susceptibility, which refers to the overall attraction of the compond to a magnetic force. An alteration of the surface magnetic characteristics will alter the magnetic susceptibility. The metal treatment of the inventive process alters the surface characteristics of the ore particles in order to enhance the magnetic susceptibility of the particles. It is to be understood that the magnetic susceptibility of the original particle is not actually changed, but the particle itself is changed, at least at its surface, resulting in a different particle possessing a greater magnetic susceptibility than the original particle. For convenience of discussion, this alteration is termed herein as "enhancing the magnetic susceptibility" of the particle or ore itself.

The sulfide minerals which are capable of undergoing a selective magnetic enhancement in accordance with the process include the metal sulfides of groups VIB, VIIB, VIIIB, IB, IIB, IIIA, IVA and VA. These sulfides preferably specifically include the sulfides of molybdenum, tungsten, manganese, rhenium, iron, ruthenium, osmium, cobalt, rhodium, iridium, nickel, palladium, platinum, copper, gold, silver, zinc, cadmium, mercury, tin, lead, arsenic, antimony and bismuth.

The gangue minerals from which the metal sulfides can be separated include those minerals which do not undergo a sufficient magnetic susceptibility enhancement as a result of the process. These gangue minerals include, for example, silica, alumina, gypsum, muscovite, dolomite, calcite, albite and feldspars, as well as various other minerals. The term gangue as used herein refers to inorganic minerals with which sulfide ores are normally associated. The term does not include coal.

In those ores which contain naturally relatively strongly magnetic constituents, such as magnetite, the magnetic material may first be removed by passing the mixture through a magnetic separator. The nonmagnetic portion obtained by this precleaning step is then subjected to the treatment with a metal containing compound.

Prior to the treatment, the ore must be ground to liberate the metal sulfide particles from the gangue particles, if the respective components do not already exist in this liberated state. The ore may be crushed finer than necessary to achieve liberation, but this is not generally economically feasible. It is generally satisfactory to crush the ore to at least about minus 14 mesh, although some ores require finer mesh sizes.

Numerous metal containing compounds are capable of enhancing the magnetic susceptibility of the metal sulfides in accordance with the invention. Many iron containing compounds possess the capability of enhancing the magnetic susceptibility of the mineral values of the ore, as long as the compound is adaptable so as to bring the iron in the compound into contact with the mineral value under conditions such as to cause an alteration of at least a portion of the surface of the mineral value.

Iron containing compounds capable of exerting sufficient vapor pressure, with iron as a component in the vapor, so as to bring the iron into contact with the value at the reaction temperature are suitable, as well as other organic and inorganic iron containing compounds which can be dissolved and/or "dusted" and brought into contact with the mineral value contained within the ore. Preferred compounds within the vapor pressure group are those which exert a vapor pressure, with iron as a component in the vapor, of at least about 10 millimeters of mercury, more preferably of at least about 25 millimeters of mercury and most preferably of at least about 50 millimeters of mercury at the reaction temperature. Examples of groupings which fall within this vapor pressure definition include ferrocene and its derivatives and beta-diketone compounds of iron. Specific examples include ferrocene and iron acetylacetonate.

Other organic compounds which may be utilized to enhance the magnetic susceptibility include those which may be homogeneously mixed with a carrier liquid and brought into contact with the components of the ore. Such mixtures include, for example, solutions, suspensions and emulsions. These compounds must be such as to provide sufficient metal to contact the surface of the mineral value. Suitable carrier liquids include, for example, acetone, petroleum ether, naphtha, hexane, benzene and water; but this, of course, is dependent upon the particular metal compound being employed. Specific groupings include, for example, ferrocene and its derivatives and the carboxylic acid salts of iron, such as, iron octoate, iron naphthenate, iron stearate and ferric acetylacetonate.

Additionally, solid organic iron containing compounds capable of being directly mixed with the ore in solid form possess the capability of enhancing the magnetic susceptibility of the metal sulfides. The compound must be in solid form at the mixing temperature and be of sufficiently fine particle size in order to be able to be well dispersed throughout the ore. The particle size is preferably smaller than about 20-mesh, more preferably smaller than about 100-mesh, and most preferably smaller than about 400-mesh. Compounds within this grouping include ferrocene and its derivatives, iron salts of organic acids, and beta-diketone compounds of iron. Specific examples include ferrous formate, 1,1'-diacetyl ferrocene, and 1,1'-dihydroxymethyl ferrocene.

Various inorganic compounds are also capable of producing an enhanced magnetic susceptibility. Preferred inorganic compounds include ferrous chloride, ferric chloride and the metal carbonyls, including, for example, iron, nickel, cobalt, molybdenum, tungsten and chromium carbonyls and derivatives of these compounds. Iron carbonyl is a preferred carbonyl for imparting this magnetic susceptibility, particularly iron pentacarbonyl, iron dodecacarbonyl and iron nonacarbonyl. The more preferred metal containing compounds capable of enhancing the magnetic susceptibility are iron pentacarbonyl, ferrocene and ferric acetylacetonate, with iron pentacarbonyl being the most preferred.

The process is applied by contacting the iron containing compound with the ore at a temperature wherein the iron containing compound selectively decomposes or otherwise reacts at the surface of the metal sulfide particles to alter their surface characteristics, while remaining essentially unreactive, or much less reactive, at the surface of the gangue particles. The temperature of the reaction is a critical parameter, and dependent primarily upon the particular compound and the particular ore. The preferred temperature can be determined by heating a sample of the specific iron containing compound and the specific ore together until the decomposition reaction occurs. Suitable results generally occur over a given temperature range for each system. Generally temperatures above the range cause non-selective decomposition while temperatures below the range are insufficient for the reaction to occur.

While as indicated above, techniques other than vapor injection methods may be employed as applicable depending upon the metal containing compound being utilized, the following discussion primarily applies to vapor injection techniques, specifically iron pentacarbonyl, as these are generally preferred. Similar considerations, as can be appreciated, apply to the other described techniques.

The preferred temperatures when iron pentacarbonyl is employed as the treating gas are primarily dependent upon the ore being treated. It is generally preferred to select a temperature which is within a range of 125° C., more preferably 50° C., and most preferably 15° C. less than the general decomposition temperature of the iron carbonyl in the specific system. The general decomposition temperature is intended to mean the temperature at which the iron carbonyl decomposes into iron and carbon monoxide in indiscriminate fashion, causing a magnetic enhancement of the gangue as well as the metal sulfide. The "specific system" is intended to include all components and parameters, other than, of course, temperature, of the precise treatment, as the general decomposition temperature varies with different components and/or different parameters. This decomposition temperature range can be readily determined by analytical methods and often a trial and error approach is preferred to determine the precise temperature range for each specific system.

The amount of the metal containing compound used and the time of treatment can be varied to maximize the selective enhancement treatment. With respect to iron carbonyl the preferred amount employed is from about 0.1 to about 100 kilograms per metric ton of feed, more preferably from about 1 to about 50 kilograms per metric ton of feed, and most preferably from about 2 to 20 kilograms per metric ton of feed. The treatment reaction is generally conducted for a period of time of from about 0.05 to about 4 hours, more preferably from about 0.15 to about 2 hours, and most preferably from about 0.25 to about 1 hour.

After the feed mixture containing the metal sulfide values has been treated with a metal containing compound, it can then be subjected to a magnetic separation process to effect the separation of the sulfides. Any of many commercially available magnetic separators can be used to remove these values from the gangue. For example, low or medium intensity separations can be made with a permanent magnetic drum separator, electromagnetic drum separators, induced roll separators or other configurations known to those skilled in the art. Since most sulfides are liberated at a mesh size of 65 mesh or finer, a wet magnetic separation process is more effective. Thus, high intensity, high gradient wet magnetic separators are preferred. Also electrostatic techniques may be employed as the primary separation means, or in addition to the magnetic separation means. The selective change in surface characteristics changes the electrical conductivity of the particle in analogous fashion to changing the particle's magnetic characteristics. Additionally, due to the fact that the sulfide surface characteristics have been altered, the sulfides are often more amendable to processes such as flotation and chemical leaching.

EXAMPLE 1

Samples of three different synthetic ores, 3% galena, 3% sphalerite and 5% molybdenite, obtained by grinding the mineral to minus 65 mesh and mixing with minus 65 mesh sand, were treated at 400° C. with 16 kilograms of ferrocene per metric ton of ore. The ferrocene had been dissolved in petroleum ether and mixed with the ore sample. The petroleum ether was then evaporated through gentle heating. Thereafter, the treated ore sample was placed in the reactor and the temperature was slowly raised to 400° C. over a two hour period. Identical samples were treated to the above procedure with the omission of ferrocene in order to obtain comparative data. The results are presented below in Table 1.

TABLE 1

| Mineral | Dosage (kg/m ton) | Product | Weight (%) | Grade (%) | Metal | Metal Sulfide Distr. (%) |
|---|---|---|---|---|---|---|
| Galena | 16 | Magnetic | 5.1 | 9.73 | Pb | 22.6 |
| | | Nonmagnetic | 94.9 | 1.79 | Pb | 77.4 |
| | | Calculated Feed | 100.0 | 2.19 | Pb | 100.0 |
| Galena | 0 | Magnetic | 0.48 | 10.2 | Pb | 2.4 |
| | | Nonmagnetic | 99.52 | 1.99 | Pb | 97.6 |
| | | Calculated Feed | 100.00 | 2.03 | Pb | 100.0 |
| Sphalerite | 16 | Magnetic | 4.1 | 8.59 | Zn | 21.5 |
| | | Nonmagnetic | 95.9 | 1.34 | Zn | 78.5 |
| | | Calculated Feed | 100.0 | 1.64 | Zn | 100.0 |
| Sphalerite | 0 | Magnetic | 0.49 | 6.19 | Zn | 1.8 |
| | | Nonmagnetic | 99.51 | 1.63 | Zn | 98.2 |
| | | Calculated Feed | 100.00 | 1.65 | Zn | 100.0 |
| Molybdenite | 16 | Magnetic | 11.8 | 0.953 | Mo | 66.6 |
| | | Nonmagnetic | 82.2 | 0.064 | Mo | 33.4 |
| | | Calculated Feed | 100.0 | 0.165 | Mo | 100.0 |
| Molybdenite | 0 | Magnetic | 0.68 | 0.961 | Mo | 4.4 |
| | | Nonmagnetic | 99.32 | 0.143 | Mo | 95.6 |
| | | Calculated Feed | 100.0 | 0.148 | Mo | 100.0 |

EXAMPLE 2

Samples of galena, sphalerite and molybdenite identical with those used in Example 1 were treated with 16 kilograms of ferric acetylacetonate per metric ton of ore at a temperature of 270° C. for 15 minutes. The acetylacetonate was injected into the reactor in a volatilized form. Again, samples of the same ore were subjected to the above procedure with the omission of the ferric acetylacetonate in order to obtain comparative blanks. The data from these tests are presented below in Table 2.

TABLE 2

| Mineral | Dosage (kg/m ton) | Product | Weight (%) | Grade (%) | Metal | Metal Sulfide Distr. (%) |
|---|---|---|---|---|---|---|
| Galena | 16 | Magnetic | 4.5 | 4.11 | Pb | 9.4 |
| | | Nonmagnetic | 95.5 | 1.86 | Pb | 90.6 |
| | | Calculated Feed | 100.0 | 1.96 | Pb | 100.0 |
| Galena | O | Magnetic | .52 | 6.93 | Pb | 1.9 |
| | | Nonmagnetic | 99.48 | 1.86 | Pb | 98.1 |
| | | Calculated Feed | 100.00 | 1.89 | Pb | 100.0 |
| Sphalerite | 16 | Magnetic | 5.1 | 5.63 | Zn | 16.6 |
| | | Nonmagnetic | 94.9 | 1.52 | Zn | 83.4 |
| | | Calculated Feed | 100.0 | 1.73 | Zn | 100.0 |
| Sphalerite | 0 | Magnetic | 0.54 | 10.2 | Zn | 3.1 |
| | | Nonmagnetic | 99.46 | 1.72 | Zn | 96.9 |
| | | Calculated Feed | 100.0 | 1.77 | Zn | 100.0 |
| Molybdenite | 16 | Magnetic | 4.3 | .801 | Mo | 20.8 |
| | | Nonmagnetic | 95.7 | .137 | Mo | 79.2 |
| | | Calculated Feed | 100.0 | .166 | Mo | 100.0 |
| Molybdenite | 0 | Magnetic | 0.55 | 1.04 | Mo | 4.1 |
| | | Nonmagnetic | 99.45 | .136 | Mo | 95.9 |
| | | Calculated Feed | 100.00 | .141 | Mo | 100.0 |

EXAMPLE 3

A sample of chalcopyrite in a silica-alumina gangue was treated with 32 kilograms of iron carbonyl per metric ton of feed, while it was rotating in a glass reaction vessel at 125° C. for 30 minutes. After purging with helium, the treated material was subjected to a magnetic separation step in a Dings cross-belt magnetic separator. Another sample of chalcopyrite in silica and alumina, identical in all respects to the first sample except that it was not treated with iron carbonyl, was also passed through the magnetic separator. The products were chemically analyzed for copper.

Results of these tests are shown in the following table:

TABLE 3

| Treatment Conditions of Chalcopyrite | Fraction | Weight % of Sample | Copper Analysis, % | Copper Distr. % |
|---|---|---|---|---|
| Not treated with iron carbonyl | Concentrate (Magnetic) | 1.27 | 17.70 | 25.0 |
| | Gangue (Nonmagnetic) | 98.73 | 0.68 | 75.0 |
| Treated by the process as described above (125° C., 30 min. 32 kg. metric ton $Fe(CO)_5$) | Concentrate (Magnetic) | 4.42 | 14.30 | 91.7 |
| | Gangue (Nonmagnetic) | 95.58 | 0.06 | 8.3 |

EXAMPLE 4

A small sample of chalcocite mixed with silica was packed in a glass tube and 57–75 milliliters per minute of nitrogen gas saturated with iron carbonyl was passed through the stationary sample bed held at 195° C. for 30 minutes. A hand magnet was used to separate the material into two portions, a magnetic and a nonmagnetic fraction. Microscopic examination clearly showed that the magnetic fraction was much richer in chalococite than the nonmagnetic fraction.

EXAMPLE 5

A sample of galena in a silica-alumina matrix was treated in the same manner as described in Example 3 except it was treated with 46 kilograms of iron carbonyl per metric ton of feed while increasing the temperature from 25° C. to 125° C. Another sample was treated at 115° C. for 30 minutes with 32 kilograms of iron carbonyl per metric ton of feed. A third sample was not treated with iron carbonyl. All three samples were then passed through the cross-belt magnetic separator, with the results shown in the following table:

TABLE 4

| Treatment Conditions of Galena | Fraction | Weight (%) | Lead Grade (%) | Lead Distr. (%) |
|---|---|---|---|---|
| No treatment | Concentrate (Magnetic) | 0.06 | 2.3 | 0.03 |
| | Gangue (Nonmagnetic) | 99.94 | 4.0 | 99.97 |
| 115° C. 30 min. 32 kg. $Fe(CO)_5$ per metric ton | Concentrate (Magnetic) | 0.41 | 63.3 | 6.27 |
| | Gangue (Nonmagnetic) | 99.59 | 3.9 | 93.78 |
| 25 to 125° C. 46 kg. $Fe(CO)_5$ per metric ton | Concentrate (Magnetic) | 0.67 | 47.2 | 8.06 |
| | Gangue (Nonmagnetic) | 99.33 | 3.6 | 91.94 |

EXAMPLE 6

For this example, pure cerussite was mixed with silica and alumina. After treatment with 32 kilograms per metric ton iron carbonyl at 105° C. for 30 minutes, only negligible traces of cerussite mineral were responsive to the magnet.

EXAMPLE 7

A sample of molybdenite ground to minus 65-mesh was mixed with minus 65-mesh silica sand to produce a 5% synthetic ore. A sample of this ore was treated at 140° C. for 30 minutes with 8 kilograms of iron pentacarbonyl per metric ton of feed. Thereafter, the mixture was subjected to a magnetic separation process to remove the molybdenum. Pertinent data are given below:

TABLE 5

| Products | Yield Wt. (%) | Molybdenum, (%) | Molybdenite Distr. (%) |
|---|---|---|---|
| Magnetic | 14.9 | 1.16 | 88.0 |
| Nonmagnetic | 85.1 | 0.0277 | 12.0 |
| Calc head | 100.0 | 0.196 | 100.0 |

EXAMPLE 8

Samples of galena, sphalerite and molybdenite were ground to minus 65-mesh and mixed with minus 65-mesh silica sand to produce the synthetic ores of 3% galena, 3% sphalerite and 5% molybdenite, respectively. Samples of each of these ores were treated for 30 minutes at the temperatures indicated in Table 6 with 8 kilograms of iron pentacarbonyl per metric ton of feed. Comparative results were obtained by treating another sample of each of the ores exactly the same but with the omission of the iron carbonyl. All of the samples were subjected to a magnetic separation process and the results are given below in Table 6.

TABLE 6

| Mineral | Temp. (°C.) | $Fe(CO)_5$ Dosage (kg/m ton) | Product | Weight (%) | Grade (%) | Metal | Metal Sulfide Distr. (%) |
|---|---|---|---|---|---|---|---|
| Galena | 136 | 8 | Magnetic | 38.8 | 6.78 | Pb | 86.5 |
| | | | Nonmagnetic | 61.2 | 0.673 | Pb | 13.5 |
| | | | Calculated Feed | 100.0 | 3.04 | Pb | 100.0 |
| Galena | 136 | 0 | Magnetic | 0.55 | 4.07 | Pb | 1.2 |
| | | | Nonmagnetic | 99.45 | 1.90 | Pb | 98.8 |
| | | | Calculated Feed | 100.00 | 1.91 | Pb | 100.0 |
| Molybdenite | 136 | 8 | Magnetic | 14.0 | 1.08 | Mo | 92.1 |
| | | | Nonmagnetic | 86.0 | 0.015 | Mo | 7.9 |
| | | | Calculated Feed | 100.0 | 0.160 | Mo | 100.0 |
| Molybdenite | 136 | 0 | Magnetic | 0.57 | 4.32 | Mo | 18.9 |
| | | | Nonmagnetic | 99.43 | 0.106 | Mo | 81.1 |
| | | | Calculated Feed | 100.0 | 0.130 | Mo | 100.0 |
| Sphalerite | 132 | 8 | Magnetic | 8.4 | 11.5 | Zn | 56.7 |
| | | | Nonmagnetic | 91.6 | 0.804 | Zn | 43.3 |
| | | | Calculated Feed | 100.0 | 1.70 | Zn | 100.0 |
| Sphalerite | 132 | 0 | Magnetic | 0.15 | 3.26 | Zn | 0.3 |
| | | | Nonmagnetic | 99.85 | 1.54 | Zn | 99.7 |
| | | | Calculated Feed | 100.00 | 1.54 | Zn | 100.0 |

EXAMPLE 9

Samples of three different synthetic ores, 5% molybdenite, 3% sphalerite and 3% galena all mixed with silica sand were treated for 30 minutes with 8 kilograms of iron carbonyl per metric ton of feed. Each of the samples were treated at the temperature indicated in Table 7. All of the samples were subjected to a magnetic separation process, the results of which are presented in Table 7.

TABLE 7

| Mineral | Temp. (%) | Fraction of Mineral-sand Mixture | Magnetic Yield, Wt. (%) | Metal Grade (%) | Metal | Metal Sulfide Distr. (%) |
|---|---|---|---|---|---|---|
| Molybdenite | 140 | Magnetic | 8.6 | 2.10 | Mo | 90.8 |

TABLE 7-continued

| Mineral | Temp. (%) | Fraction of Mineral-sand Mixture | Magnetic Yield, Wt. (%) | Metal Grade (%) | Metal | Metal Sulfide Distr. (%) |
|---|---|---|---|---|---|---|
| | | Nonmagnetic | 91.4 | 0.02 | Mo | 9.2 |
| | | Calculated Feed | 100.0 | 0.20 | Mo | 100.0 |
| Sphalerite | 135 | Magnetic | 14.3 | 4.20 | Zn | 67.3 |
| | | Nonmagnetic | 85.7 | 0.34 | Zn | 32.7 |
| | | Calculated Feed | 100.0 | 0.89 | Zn | 100.0 |
| Galena | 135 | Magnetic | 48.2 | 1.40 | Pb | 89.7 |
| | | Nonmagnetic | 51.8 | 0.15 | Pb | 10.3 |
| | | Calculated Feed | 100.0 | 0.75 | Pb | 100.0 |
| Galena | 120 | magnetic | 7.3 | 20.9 | Pb | 81.7 |
| | | Nonmagnetic | 92.7 | 0.37 | Pb | 18.3 |
| | | Calculated Feed | 100.0 | 1.87 | Pb | 100.0 |

EXAMPLE 10

Samples of 3% galena in Ottawa silica sand sized to minus 65-mesh, were treated in a reactor with 16 kilograms of ferrous chloride per metric ton of ore and also with 16 kilograms of ferric chloride per metric ton of ore. Thereafter the temperature of the reactor was raised to 330° C. over 75 minutes. Comparative data were obtained by treating samples of the ore in the same manner but with the omission of the ferrous chloride and ferric chloride. Table 8 gives the comparative results.

TABLE 8

| Mineral | Dosage (kg/m ton) | Product | Weight (%) | Grade (%) | Metal | Metal Sulfide Distr. (%) |
|---|---|---|---|---|---|---|
| Galena | none | Magnetic | 0.50 | 7.70 | Pb | 1.7 |
| | | Nonmagnetic | 99.50 | 2.30 | Pb | 98.3 |
| | | Calculated Feed | 100.00 | 2.33 | Pb | 100.0 |
| Galena | 16/$FeCl_2$ | Magnetic | 1.13 | 33.1 | Pb | 17.3 |
| | | Nonmagnetic | 98.87 | 1.81 | Pb | 82.7 |
| | | Calculated Feed | 100.00 | 2.16 | Pb | 100.0 |
| Galena | 16/$FeCl_3$ | Magnetic | 2.4 | 25.7 | Pb | 72.2 |
| | | Nonmagnetic | 97.6 | 0.244 | Pb | 27.8 |
| | | Calculated Feed | 100.0 | 0.855 | Pb | 100.0 |

EXAMPLE 11

Samples of different sphalerites were ground to minus 65-mesh and mixed with minus 65-mesh silica sand to a 3% synthetic ores. A sample of each of these ores were treated with 8 kilograms of iron pentacarbonyl per metric ton of ore for 30 minutes at the temperature indicated in Table 9. All of the samples were subjected to a magnetic separation process and the results are below in Table 9.

TABLE 9

| Sample Origin | Temp. (°C.) | Product | Weight (%) | Grade (%) | Sphalerite Distr. (%) |
|---|---|---|---|---|---|
| Timmins, Ont. | 130 | Magnetic | 3.8 | 15.0 | 64.2 |
| | | Nonmagnetic | 96.2 | 0.331 | 35.8 |
| | | Calculated Feed | 100.0 | 0.888 | 100.0 |
| Creede, CO | 130 | Magnetic | 5.5 | 3.10 | 36.6 |
| | | Nonmagnetic | 94.5 | 0.312 | 63.4 |
| | | Calculated Feed | 100.0 | 0.465 | 100.0 |
| Balmat, NY | 130 | Magnetic | 4.0 | 21.9 | 74.0 |
| | | Nonmagnetic | 96.0 | 0.320 | 26.0 |
| | | Calculated Feed | 100.0 | 1.18 | 100.0 |
| Beaver County, UT | 130 | Magnetic | 9.6 | 5.02 | 51.4 |
| | | Nonmagnetic | 90.4 | 0.504 | 48.6 |
| | | Calculated Feed | 100.0 | 0.938 | 100.0 |
| Beaver County, UT | 105 | Magnetic | 6.5 | 5.12 | 36.5 |
| | | Nonmagnetic | 93.5 | 0.619 | 63.5 |
| | | Calculated Feed | 100.0 | 0.912 | 100.0 |

EXAMPLE 12

A sample of molybdenite was ground to minus 65-mesh and mixed with minus 65-mesh silica sand to produce a 5% synthetic ore. Several 1 kilogram samples of this ore were treated with iron carbonyl at a dosage and temperature indicated in Table 10 for 30 minutes. The samples were subjected to a magnetic separation process and the following results were obtained.

TABLE 10

| Temperature (°C.) | $Fe(CO)_5$ Dosage (kg/m ton) | Molybdenite Product | Weight (%) | Grade (%) | Distr. (%) |
|---|---|---|---|---|---|
| 135 | 1.5 | Magnetic | 2.3 | 6.85 | 87.0 |
| | | Nonmagnetic | 97.7 | 0.024 | 13.0 |
| | | Calculated Feed | 100.0 | 0.181 | 100.0 |
| 135 | 1.5 | Magnetic | 2.8 | 5.80 | 85.6 |
| | | Nonmagnetic | 97.2 | 0.028 | 14.4 |
| | | Calculated Feed | 100.0 | 0.190 | 100.0 |
| 135 | 1.5 | Magnetic | 4.6 | 3.73 | 97.3 |
| | | Nonmagnetic | 95.4 | 0.005 | 2.7 |
| | | Calculated Feed | 100.0 | 0.176 | 100.0 |
| 135 | 1.5 | Magnetic | 5.0 | 3.38 | 97.3 |
| | | Nonmagnetic | 95.0 | 0.005 | 2.7 |
| | | Calculated Feed | 100.0 | 0.174 | 100.0 |
| 135 | 1.5 | Magnetic | 5.4 | 3.05 | 98.3 |
| | | Nonmagnetic | 94.6 | 0.003 | 1.7 |
| | | Calculated Feed | 100.0 | 0.168 | 100.0 |
| 135 | 1.5 | Magnetic | 5.2 | 3.52 | 98.0 |
| | | Nonmagnetic | 94.8 | 0.004 | 2.0 |
| | | Calculated Feed | 100.0 | 0.187 | 100.0 |
| 120 | 11.75 | Magnetic | 2.6 | 6.29 | 84.8 |
| | | Nonmagnetic | 97.4 | 0.030 | 15.2 |
| | | Calculated Feed | 100.0 | 0.193 | 100.0 |
| 120 | 11.75 | Magnetic | 3.6 | 4.46 | 91.2 |
| | | Nonmagnetic | 96.4 | 0.016 | 8.8 |
| | | Calculated Feed | 100.0 | 0.176 | 100.0 |
| 120 | 11.75 | Magnetic | 4.0 | 4.23 | 96.2 |
| | | Nonmagnetic | 96.0 | 0.007 | 3.8 |
| | | Calculated Feed | 100.0 | 0.176 | 100.0 |
| 120 | 11.75 | Magnetic | 3.8 | 4.58 | 96.8 |
| | | Nonmagnetic | 96.2 | 0.006 | 3.2 |
| | | Calculated Feed | 100.0 | 0.180 | 100.0 |
| 120 | 11.75 | Magnetic | 3.6 | 4.99 | 96.9 |
| | | Nonmagnetic | 96.4 | 0.006 | 3.1 |

TABLE 10-continued

| Temperature (°C.) | $Fe(CO)_5$ Dosage (kg/m ton) | Product | Weight (%) | Grade (%) | Molybdenite Distr. (%) |
|---|---|---|---|---|---|
| | | Calculated Feed | 100.0 | 0.185 | 100.0 |
| 120 | 11.75 | Magnetic | 3.4 | 5.27 | 96.9 |
| | | Nonmagnetic | 96.6 | 0.006 | 3.1 |
| | | Calculated Feed | 100.0 | 0.185 | 100.0 |

EXAMPLE 13

Samples of different minerals were ground to minus 65-mesh and mixed with minus 65-mesh silica sand to produce 3% synthetic ores. Each sample was treated for 30 minutes with 8 kilograms of iron carbonyl per metric ton of feed. The temperature of the treatment varied for the different minerals and is given below as are the data relating to the wet magnetic recovery of the metals.

TABLE 11

| Mineral | Temp. (°C.) | Product | Yield Wt. (%) | Metal Gr. (%) | Metal | Metal Sulfide Distr. (%) |
|---|---|---|---|---|---|---|
| Bornite | 140 | Magnetic | 3.6 | 29.7 | Cu | 78.0 |
| | | Nonmagnetic | 96.4 | 0.313 | Cu | 22.0 |
| | | Calculated Feed | 100.0 | 1.37 | Cu | 100.0 |
| Cinnabar | 190 | Magnetic | 1.6 | 48.1 | Hg | 43.9 |
| | | Nonmagnetic | 98.4 | 1.0 | Hg | 56.1 |
| | | Calculated Feed | 100.0 | 1.75 | Hg | 100.0 |
| Arsenopyrite | 125 | Magnetic | 7.4 | 1.01 | As | 31.0 |
| | | Nonmagnetic | 92.6 | 0.18 | As | 69.0 |
| | | Calculated Feed | 100.0 | 0.24 | As | 100.0 |
| Smaltite | 115 | Magnetic | 1.2 | 5.37 | Co | 22.1 |
| | | Nonmagnetic | 98.8 | 0.23 | Co | 77.9 |
| | | Calculated Feed | 100.0 | 0.29 | Co | 100.0 |
| Smaltite | 115 | Magnetic | 1.2 | 3.35 | Ni | 22.5 |
| | | Nonmagnetic | 98.8 | 0.14 | Ni | 77.5 |
| | | Calculated Feed | 100.0 | 0.18 | Ni | 100.0 |
| Chalcocite | 140 | Magnetic | 3.4 | 50.8 | Cu | 90.5 |
| | | Nonmagnetic | 96.6 | 0.188 | Cu | 9.5 |
| | | Calculated Feed | 100.0 | 1.91 | Cu | 100.0 |
| Chalcopyrite | 140 | Magnetic | 1.8 | 20.5 | Cu | 48.4 |
| | | Nonmagnetic | 98.2 | 0.401 | Cu | 51.6 |
| | | Calculated Feed | 100.0 | 0.76 | Cu | 100.0 |
| Orpiment | 110 | Magnetic | 20.1 | 2.0 | As | 40.5 |
| | | Nonmagnetic | 79.9 | 0.74 | As | 59.5 |
| | | Calculated Feed | 100.0 | 0.99 | As | 100.0 |
| Realgar | 95 | Magnetic | 23.2 | 2.02 | As | 36.5 |
| | | Nonmagnetic | 76.8 | 1.06 | As | 63.5 |
| | | Calculated Feed | 100.0 | 1.28 | As | 100.0 |
| Pentlandite in Pyrrhotite | 105 | Magnetic | 18.2 | 0.733 | Ni | 92.1 |
| | | Nonmagnetic | 81.8 | 0.079 | Ni | 7.9 |
| | | Calculated Feed | 100.0 | 0.145 | Ni | 100.0 |
| Stibnite | 85 | Magnetic | 7.6 | 4.82 | Sb | 48.0 |
| | | Nonmagnetic | 92.4 | 0.43 | Sb | 52.0 |
| | | Calculated Feed | 100.0 | 0.76 | Sb | 100.0 |
| Stibnite | 85 | Magnetic | 8.1 | 3.56 | Sb | 63.4 |
| | | Nonmagnetic | 91.9 | 0.181 | Sb | 36.6 |
| | | Calculated Feed | 100.0 | 0.454 | Sb | 100.0 |
| Tetrahedrite | 117 | Magnetic | 2.9 | 4.43 | Cu | 68.8 |
| | | Nonmagnetic | 97.1 | 0.06 | Cu | 31.2 |
| | | Calculated Feed | 100.0 | 0.19 | Cu | 100.0 |
| Tetrahedrite | 117 | Magnetic | 2.9 | 0.256 | Zn | 31.0 |
| | | Nonmagnetic | 97.1 | 0.017 | Zn | 69.0 |
| | | Calculated Feed | 100.0 | 0.024 | Zn | 100.0 |
| Tetrahedrite | 117 | Magnetic | 2.9 | 0.78 | Ag | 85.3 |
| | | Nonmagnetic | 97.1 | 0.004 | Ag | 14.7 |
| | | Calculated Feed | 100.0 | 0.027 | Ag | 100.0 |
| Tetrahedrite | 117 | Magnetic | 2.9 | 2.34 | Sb | 53.4 |
| | | Nonmagnetic | 97.1 | 0.061 | Sb | 46.6 |
| | | Calculated Feed | 100.0 | 0.127 | Sb | 100.0 |

What is claimed is:

1. A process for beneficiating sulfide ores from gangue, excluding coal, which comprises contacting the sulfide ore with a metal containing compound under conditions which cause the metal containing compound to react substantially at the surface of the metal sulfide particles to the substantial exclusion of the gangue particles so as to alter the surface characteristics of the metal sulfide values thereby causing a selective enhancement of the magnetic susceptibility of one or more metal sulfide values of the ore to the exclusion of the gangue in order to permit a physical separation between the metal sulfide values and the gangue.

2. The process of claim 1 wherein the metal mineral values of the ore undergo an increase in magnetic susceptibility.

3. The process of claim 1 wherein the treated ore is subjected to a magnetic field to separate the particles which have been made magnetic from those which have not.

4. The process of claim 1 wherein the ore is ground to liberate the metal sulfide particles prior to its treatment with the metal containing compound.

5. The process of claim 1 wherein the sulfide ore in a specific system is contacted with the metal containing compound at a temperature within a range of 125° C. less than the general decomposition temperature of the metal containing compound in a specific system for the ore being treated.

6. The process of claim 1 wherein the metal containing compound is employed in an amount from about 0.1 to about 100 kilograms per metric ton of ore.

7. The process of claim 1 wherein the sulfide ore is contacted with the metal containing compound for a time period of from about 0.05 to about 4 hours.

8. A process for the beneficiation of a metal sulfide ore from gangue, excluding coal, wherein the ore is treated with from about 0.1 to 100 kilograms of a metal containing compound per metric ton of ore at a temperature within a range of 125° C. less than the general decomposition temperature of the metal containing compound in a specific system for the ore being treated for a period of time from about 0.05 to about 4 hours to cause the metal containing compound to react substantially at the surface of the metal sulfide particles to the substantial exclusion of the gangue particles so as to alter the surface characteristics of the metal sulfide values thereby causing a selective enhancement of the magnetic susceptibility of one or more metal sulfide values contained in the ore to the exclusion of the gangue so as to permit a physical separation between the metal sulfide values and the gangue.

9. The process of claim 1 or claim 8 wherein the metal containing compound is an iron containing compound.

10. The process of claim 9 wherein the iron containing compound is selected from the group consisting of ferrous chloride, ferric chloride, ferrocene derivatives, ferric acetylacetonate and ferric acetylacetonate derivatives.

11. The process of claim 1 or claim 8 wherein the metal containing compound is a carbonyl.

12. The process of claim 11 wherein the carbonyl is selected from the group consisting of iron, cobalt and nickel.

13. The process of claim 12 wherein the iron carbonyl comprises iron pentacarbonyl.

14. The process of claim 12 wherein the metal containing compound is employed in an amount of from about 1 to about 50 kilograms per metric ton of ore and the process is carried out at a temperature within a range of 50° C. less than the general decomposition temperature of the metal containing compound in a specific system for the ore being treated for a period of time from about 0.15 to about 2 hours.

15. The process of claim 14 wherein the metal containing compound is employed in an amount of from about 2 to about 20 kilograms per metric ton of ore.

16. The process of claim 15 wherein the metal containing compound is iron carbonyl and the treatment process is carried out at a temperature within a range of 15° C. less than the general decomposition temperature of the iron carbonyl in the specific system for the ore being treated.

17. The process of claim 1 or claim 8 wherein the metal sulfide values are physically separated from the gangue by a magnetic separation process.

18. The process of claim 17 wherein the magnetic separation process is a wet magnetic separation process.

19. The process of claim 1 or claim 8 wherein the metal sulfide values are physically separated from the gangue by an electrostatic technique.

20. The process of claim 10 wherein the iron containing compound is selected from the group consisting of ferrous chloride, ferric chloride, ferrocene and ferric acetylacetonate.

21. The process of claim 20 wherein the iron containing compound is ferrous chloride.

22. The process of claim 20 wherein the iron containing compound is ferric chloride.

23. The process of claim 20 wherein the iron containing compound is ferrocene.

24. The process of claim 20 wherein the iron containing compound is ferric acetylacetonate.

25. A process for the beneficiation of a metal sulfide ore from gangue, excluding coal, selected from the group consisting of galena, molybdenite, sphalerite, bornite, cinnabar, arsenopyrite, smaltite, chalcocite, chalcopyrite, orpiment, realgar, pentlandite in pyrrhotite, stibnite and tetrahedrite which comprises for the ore in a specific system contacting the sulfide ore with an iron containing compound selected from the group consisting of ferrous chloride, ferric chloride, ferrocene, ferric acetylacetonate and iron pentacarbonyl at a temperature within a range of 125° C. less than the general decomposition temperature of the iron containing compound in the specific system for the ore being treated for a period of time from about 0.15 to about 2 hours to cause the iron containing compound to react substantially at the surface of the metal sulfide particles to the substantial exclusion of the gangue particles so as to alter the surface characteristics of the metal sulfide values thereby causing a selective enhancement of the magnetic susceptibility of one or more metal sulfide values of the ore to the exclusion of the gangue in order to permit a magnetic separation between the metal sulfide values and the gangue.

26. The process of claim 25 wherein the iron containing compound is iron pentacarbonyl employed in an amount from about 1 to about 50 kilograms per metric ton of ore and the process is conducted at a temperature within a range of 15° C. less than the general decomposition temperature of the iron carbonyl in the specific system for the ore being treated for a time period of from about 0.15 to about 2 hours.

27. The process of claim 26 wherein the metal sulfide ore is galena.

28. The process of claim 26 wherein the metal sulfide ore is molybdenite.

29. The process of claim 26 wherein the metal sulfide ore is sphalerite.

30. The process of claim 26 wherein the metal sulfide ore is bornite.

31. The process of claim 26 wherein the metal sulfide ore is cinnabar.

32. The process of claim 26 wherein the metal sulfide ore is arsenopyrite.

33. The process of claim 26 wherein the metal sulfide ore is smaltite.

34. The process of claim 26 wherein the metal sulfide ore is chalcocite.

35. The process of claim 26 wherein the metal sulfide ore is chalcopyrite.

36. The process of claim 26 wherein the metal sulfide ore is orpiment.

37. The process of claim 26 wherein the metal sulfide ore is realgar.

38. The process of claim 26 wherein the metal sulfide ore is pentlandite.

39. The process of claim 26 wherein the metal sulfide ore is stibnite.

40. The process of claim 26 wherein the metal sulfide ore is tetrahedrite.

41. The process of claim 25 wherein the iron containing compound is ferrocene which is employed in an amount from about 2 to about 20 kilograms per metric ton of ore.

42. The process of claim 40 wherein the metal sulfide ore is galena.

43. The process of claim 40 wherein the metal sulfide ore is molybdenite.

44. The process of claim 40 wherein the metal sulfide ore is sphalerite.

45. The process of claim 25 wherein the metal containing compound is ferric acetylacetonate which is employed in an amount from about 2 to about 20 kilograms per metric ton of ore for a time period of from about 0.25 to 1 hour.

46. The process of claim 45 wherein the metal sulfide ore is galena.

47. The process of claim 45 wherein the metal sulfide ore is molybdenite.

48. The process of claim 45 wherein the metal sulfide ore is sphalerite.

49. The process of claim 25 wherein the iron containing compound is ferrous chloride which is employed in an amount from about 2 to about 20 kilograms per metric ton of ore for a period of time from about 0.15 to 2 hours.

50. The process of claim 49 wherein the metal sulfide ore is galena.

51. The process of claim 25 wherein the metal containing compound is ferric chloride which is employed in an amount from about 2 to about 20 kilograms per metric ton of ore for a time period from about 0.15 to about 2 hours.

52. The process of claim 51 wherein the metal sulfide ore is galena.

* * * * *